US006406339B1

(12) United States Patent
Sills

(10) Patent No.: US 6,406,339 B1
(45) Date of Patent: Jun. 18, 2002

(54) JOHN BOAT WITH KEEL-MOUNTED JET DRIVE

(76) Inventor: Lawrence D. Sills, 2715 Pheasant Ridge Ct., Marion, IA (US) 52302

( * ) Notice: Subject to any disclaimer, the term of this patent is extended or adjusted under 35 U.S.C. 154(b) by 0 days.

(21) Appl. No.: 09/827,684

(22) Filed: Apr. 6, 2001

(51) Int. Cl.[7] ..... B63H 11/00
(52) U.S. Cl. ..... 440/38
(58) Field of Search ..... 440/38, 40, 42, 440/43, 44

(56) References Cited

U.S. PATENT DOCUMENTS 3,134,357 A * 5/1964 Cochran ..... 440/38
3,782,320 A * 1/1974 Groves, Jr. ..... 440/38
3,797,447 A * 3/1974 Stubblefield
3,811,398 A * 5/1974 Burgin
3,911,846 A * 10/1975 England
3,943,876 A * 3/1976 Kiekhaefer
4,026,235 A * 5/1977 Woodfill
4,325,699 A * 4/1982 Castoldi ..... 440/47
4,702,724 A * 10/1987 Vater ..... 464/172
5,016,553 A * 5/1991 Spencer ..... 440/40
5,405,276 A * 4/1995 Kato ..... 440/38
D358,574 S * 5/1995 Thompson et al. ..... D12/314
5,579,711 A * 12/1996 Thomas ..... 440/38
5,803,775 A * 9/1998 Henmi ..... 440/38
5,967,868 A * 10/1999 Ito et al. ..... 440/47
5,989,083 A * 11/1999 Ishigaki et al. ..... 440/46

OTHER PUBLICATIONS

Tracker Boats Catalog, pp. 8, 9; Copyright 1998, Tracker Marine LP., Springfield, Mo.
Outboard Jets Brochure, Specialty Mfg. Co., San Leandro, CA., May 15, 1997.

* cited by examiner

*Primary Examiner*—Jesus D. Sotelo
(74) *Attorney, Agent, or Firm*—McKee, Voorhees & Sease, P.L.C.

(57) ABSTRACT

A jet driven john boat that includes a jet drive system mounted on the keel portion inside the boat hull such that operation of the boat in very shallow water is made possible. The jet drive system includes an engine and a jet pump. The jet pump has a drive shaft equipped with a cleaning tube loosely fitted thereover in a sleeve-like manner. The cleaning tube has a longitudinal slot for breaking down weeds and other debris that might be ingested into the jet pump.

11 Claims, 4 Drawing Sheets

JOHN BOAT WITH KEEL-MOUNTED JET DRIVE

BACKGROUND OF THE INVENTION

The present invention relates to the field of watercraft. More particularly, this invention relates to a john boat with a keel-mounted jet drive system. The keel-mounted jet drive system of this invention particularly useful in boating applications on shallow rivers, lakes, marshes and other areas that fishing and duck hunting enthusiasts like to reach.

Jet propelled boats and personal watercraft referred to as "jet skis" have been known for some time. However, a jet drive system has not hereto been applied very successfully to a john boat. Tracker Marine LP of Springfield, Mo., USA has recently developed a Tracker® PRO Team 18 Jet Boat. This boat utilizes a helical scroll type jet pump mounted on the transom for propulsion so that there is no propeller to damage on rocks or logs. However, because of the nature of helical scroll type jet pumps, this boat requires at least six to eight inches of draft or water to operate in. Thus, there are many shallower areas that such a boat cannot reach. Furthermore, jet pumps are sensitive to the ingestion of weeds, sand, rocks, or other debris which can often be encountered in shallow water. Therefore, there is a need for an improved john boat with jet drive.

A primary objective of the present invention is a provision of a john boat with a keel-mounted jet drive system.

A further objective of the present invention is the provision of a john boat with a jet drive system that is capable of operating in less than six inches of water.

Another objective of the present invention is a provision of a john boat with jet drive that is resistant to damage that might potentially be caused by weeds, sand, rocks, and other debris typically found in shallow water.

A further objective of this invention is the provision of a means for shredding weeds and sticks into smaller pieces before they are ingested by the jet pump.

A further objective of this invention is the provision of an in-line impeller style jet drive that avoids the higher draft requirements of a helical scroll type jet pump.

Another objective of this invention is the provision of a modular keel-mounted jet drive system that can be provided in a kit form so as to enable a standard propeller driven john boat to be converted to a jet driven john boat.

Another objective of the present invention is the provision of a keel-mounted jet drive system for a john boat that is economical to produce, easy to install, and reliable in use.

These and other objective will be apparent from the drawings, as well as from the description and claims that follow.

SUMMARY OF THE INVENTION

The present invention relates to the field of jet driven watercraft. More particularly, this invention relates to a jet driven john boat capable of operating in very shallow water. The john boat of this invention includes a jet drive system that is supported by a carrier plate mounted inside the boat hull. Advantageously the jet pump does not need to extend below the bottom keel portion of the hull.

The invention further includes a cleaning tube mounted around the drive shaft of the jet pump. The cleaning tube has a longitudinal slot that allows the tube to be spread and snapped onto the pump shaft. The longitudinal slot breaks down any weeds or other debris encountered before they are ingested by the jet pump.

The present invention provides a modular jet drive system for a john boat that can be supplied in kit form for manufacturing new john boats or for converting existing propeller driven john boats to jet driven john boats. The method of accomplishing a retrofit conversion is also disclosed herein.

DETAILED DESCRIPTION OF THE PREFERRED EMBODIMENT(S)

Figure 1:
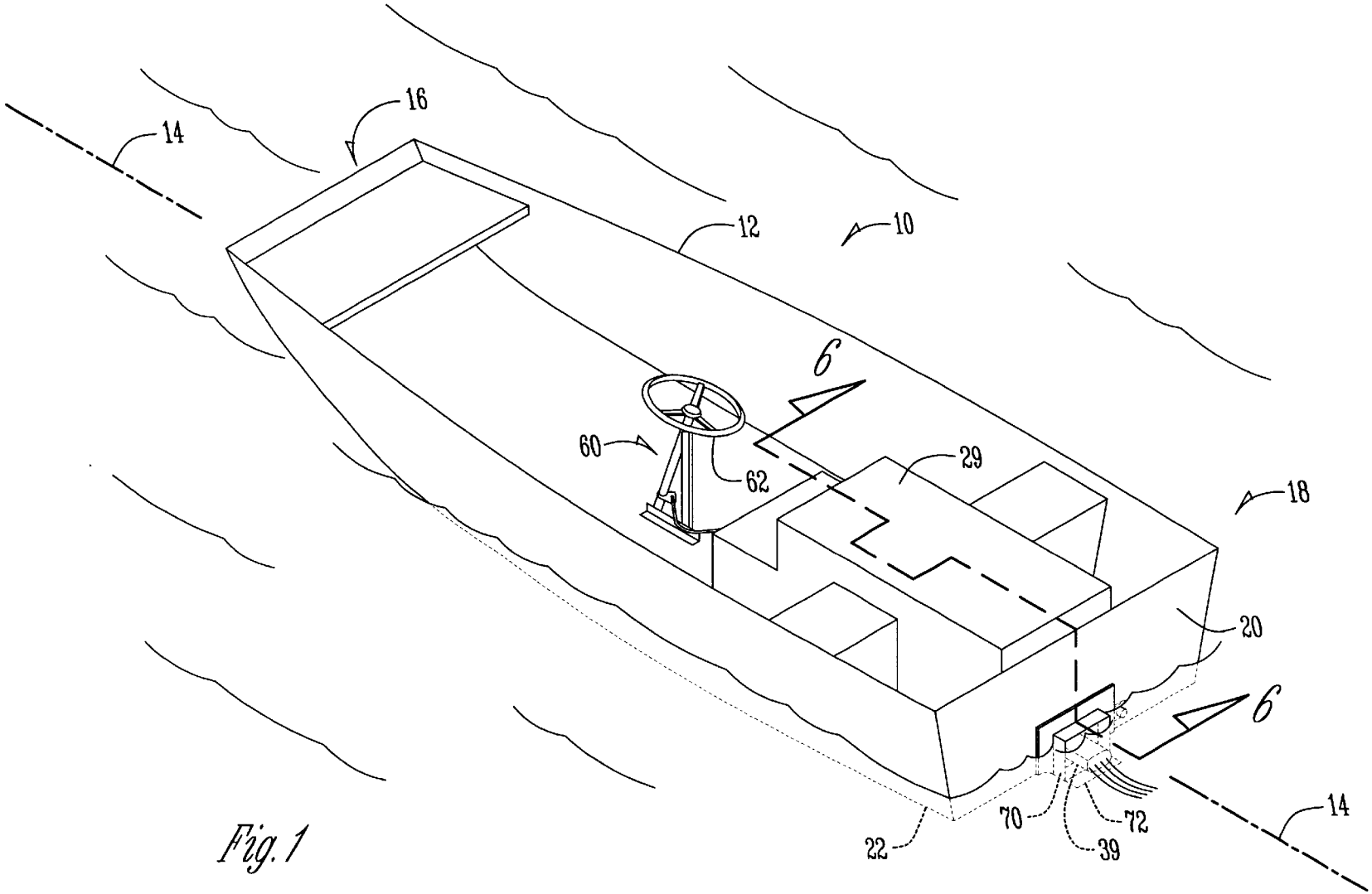
FIG. 1 is a perspective view of the jet driven john boat of this invention.
Figure 2:
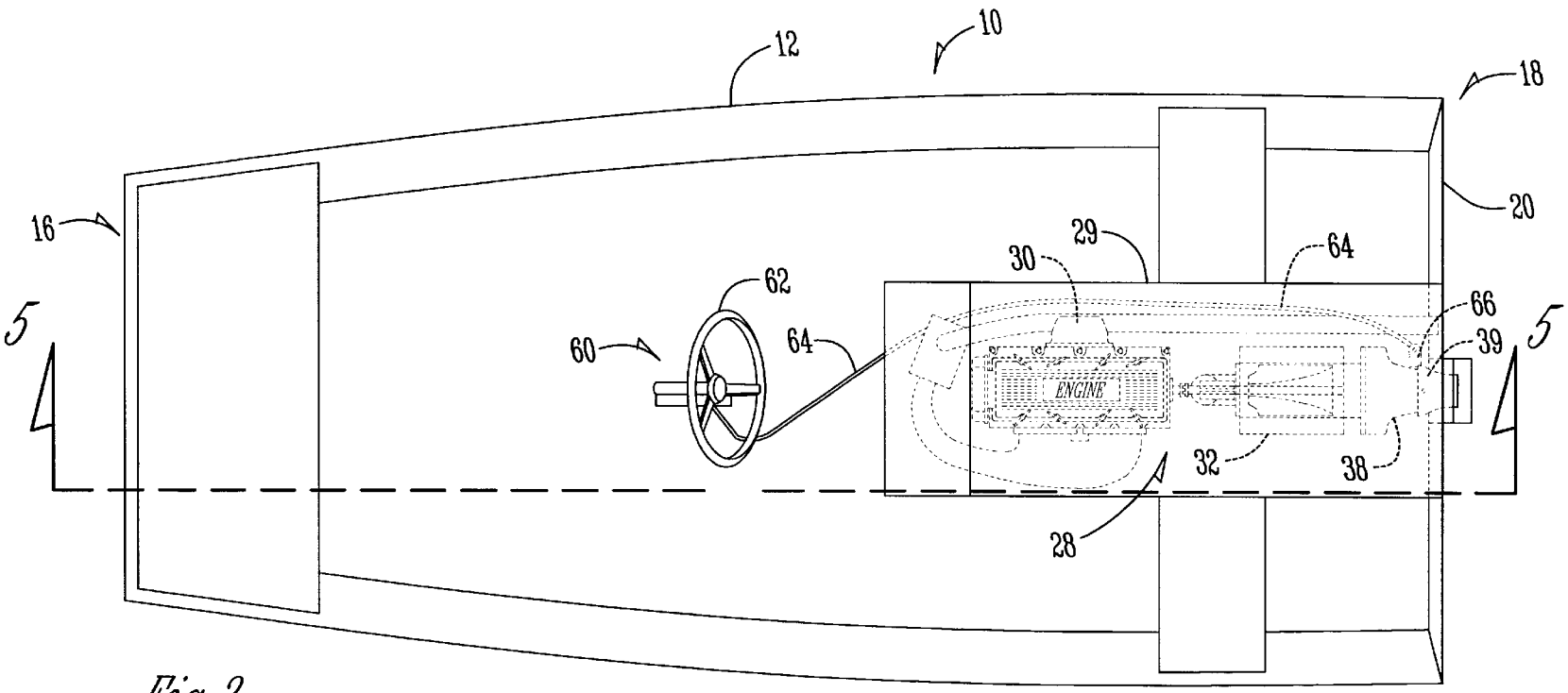
FIG. 2 is a top plan view of the boat of FIG. 1. The engine and jet pump are shown in general by dashed lines under a protective hood.

The jet driven john boat of this invention is generally designated in the figures by the reference numeral 10. Referring to FIGS. 1–4, the john boat 10 has an elongated john boat hull 12 that includes a central longitudinal axis 14, a forward end defining a bow 16, and a squared rearward end defining a stern 18 with a transom 20 extending upwardly thereon. As is conventional with boats of this type, the john boat hull 12 has a substantially flat bottom wall 22.

The bottom wall 22 includes a keel portion extending longitudinally thereon. An aperture 26 is formed through the keel portion 24 adjacent to the transom 20. The aperture 26 is at a keel level defined by the bottom wall 22 of the hull 12.

Figure 3:
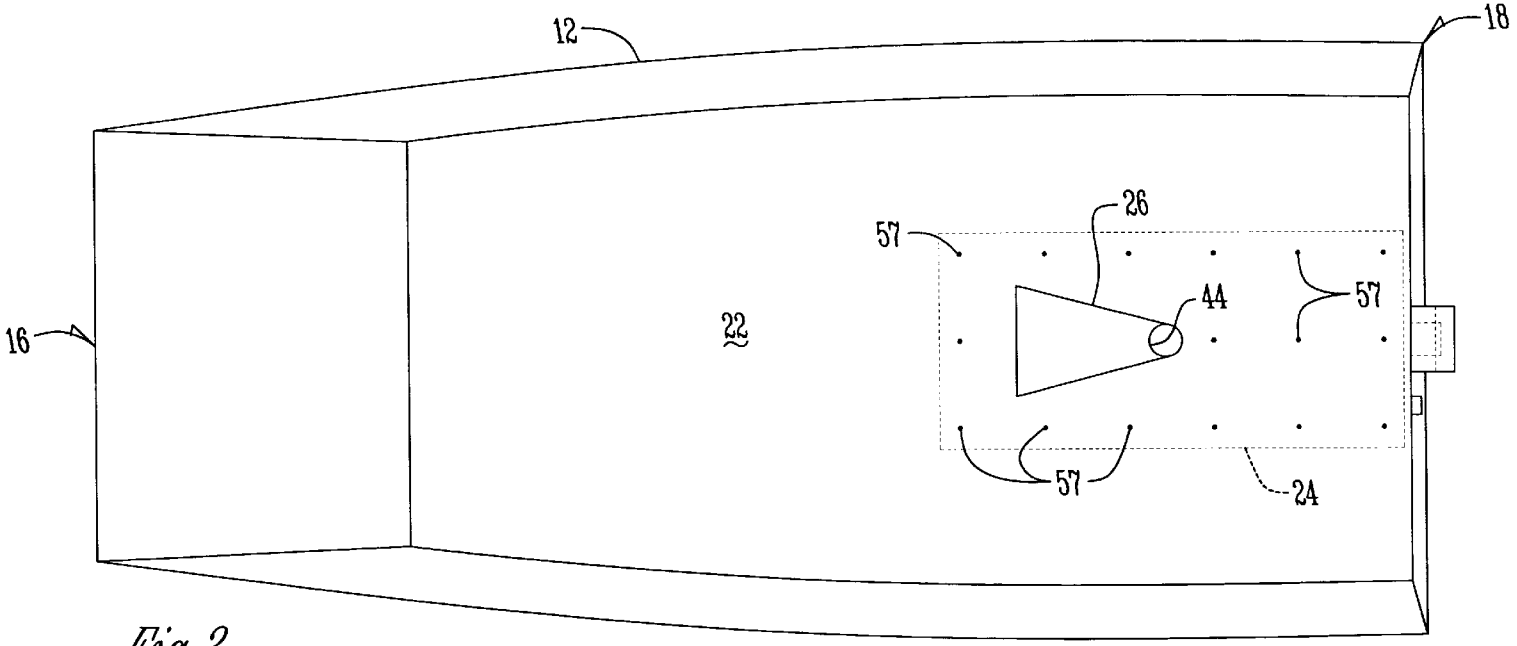
FIG. 3 is a plan view of the bottom of the boat of FIG. 1, which shows the water inlet aperture in the keel.
Figure 4:
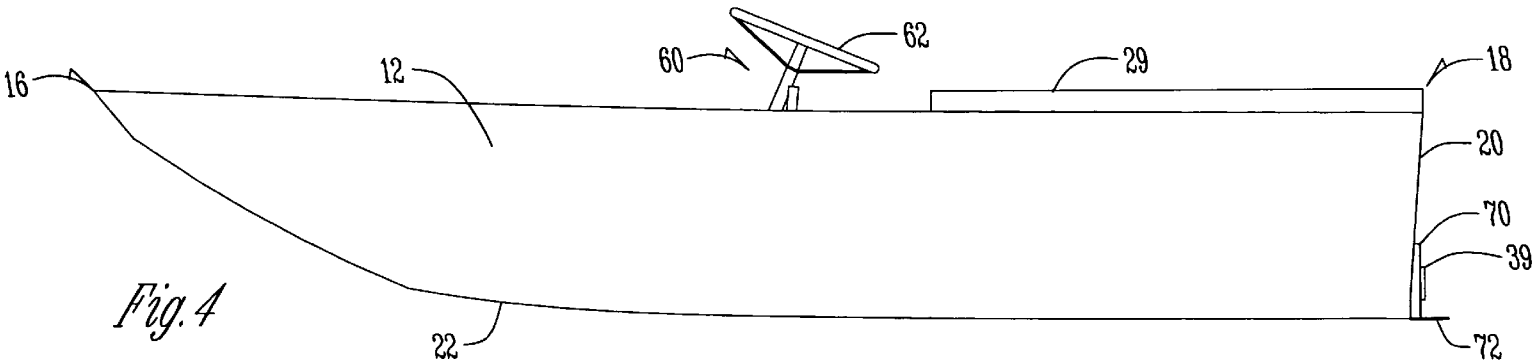
FIG. 4 is a side elevational view of the boat from FIG. 1.
Figure 5:
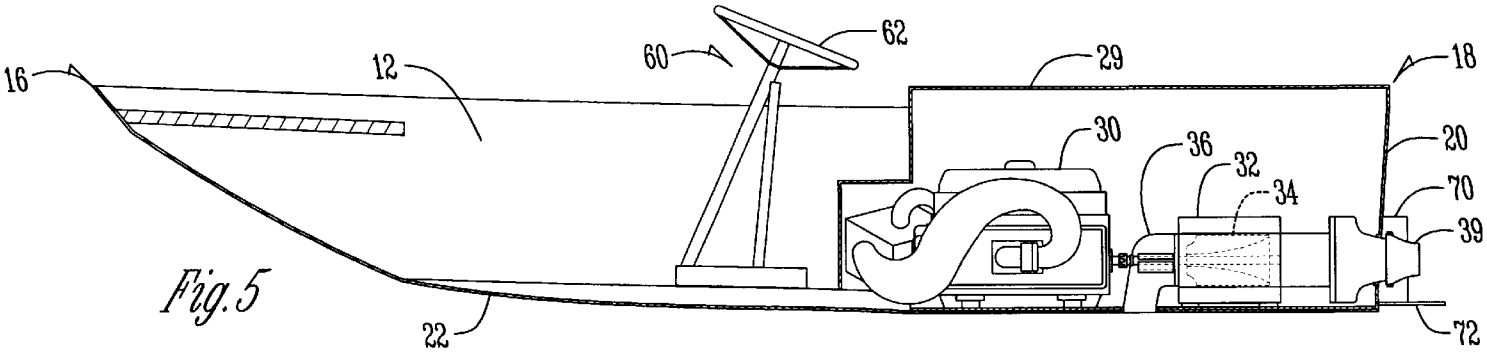
FIG. 5 is a longitudinal cross sectional view taken along line 5—5 in FIG. 2.
Figure 6:
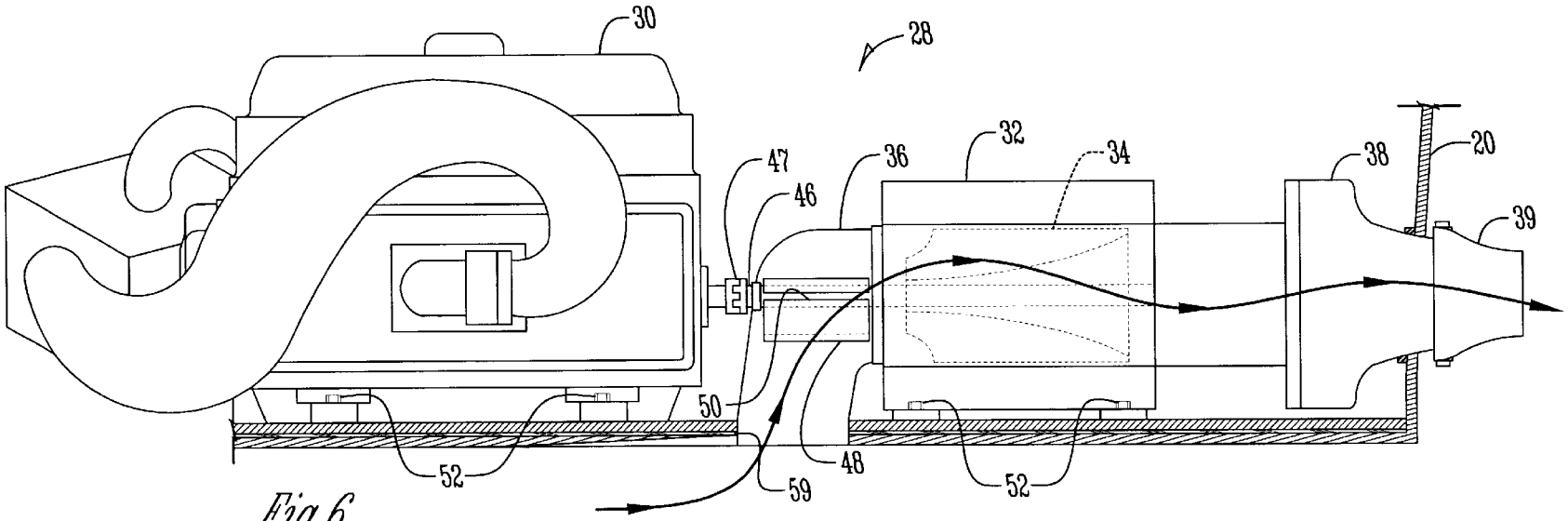
FIG. 6 is a side elevational view showing the jet drive system from FIG. 5 in greater detail.

A jet drive system 28 is mounted on the keel portion 24 inside the boat hull 12, under a protective shroud 29. The jet drive system 28 includes an engine 30 and a jet pump 32 that is driven by the engine 30. The jet pump 32 is an in-line type jet pump that has a rotatable impeller 34 and therefore is free of a helical scroll tubular passageway for accelerating fluid passing therethrough. Yamaha and Solas both manufacture and sell impeller type jet pumps that are suitable for this invention. As best seen in FIGS. 3, 5 and 6, the jet pump 32 has a suction inlet 36 in fluid communication with the aperture 26 and a pump discharge chute or tube 38 extending rearwardly toward the transom 20. The pump discharge chute 38 is an elongated tube that extends in sealed fashion through the transom 20. A directional nozzle 39 is pivotally mounted to the chute 38 in a conventional manner as shown. Preferably the upper surface 40 of the nozzle 39 is substantially parallel to and less than six inches from the bottom of the hull 12 adjacent the transom. More preferably, the distance from the upper surface 40 of the nozzle 39 is less than four inches from the bottom of the hull 12 adjacent the transom 20.

The invention is a modular jet drive system. Both the engine 30 and the jet pump 32 are mounted and supported on a carrier plate 42 that in turn is mounted on the keel portion 24. The carrier plate 42 extends substantially horizontally inside the boat hull 12 in sealed covering relation to the aperture 26. Preferably, the carrier plate 42 is a rigid stainless steel plate. However, other shapes and materials could be utilized without detracting from the present invention. For instance, aluminum might be used to save weight or a durable resilient rubber plate may be advantageous for sealing purposes and to dampen vibrations. The carrier plate 42 has a water intake or suction opening 44 therein that fluidly connects with the suction inlet 36 of the pump 32 and the aperture 26.

The carrier plate 42 has substantially planar and parallel upper and lower surfaces 56, 58. The engine 30 and the jet pump 32 are detachably mounted by conventional fastening and mounting means 52 to the carrier plate 42. Sealing means, such as a rubberized gasket 59, can be inserted between the lower surface 58 of the carrier plate 42 and the bottom wall 22 of the boat. Conventional fasteners or attachment means 57, including but not limited to screws, bolts, blind rivets and the like, are used to fasten the carrier plate 42 and the keel portion 24 of the boat hull 12 together in a sealed manner.

FIGS. 5–6 show another advantageous feature of the present invention. The pump 32 is driven by an elongated drive shaft 46 connected to the engine 30. An output shaft 31 of the engine 30 is preferably coupled with the pump drive shaft 46 by a convention coupling 47. An elongated cylindrical cleaning tube 48 is mounted on the drive shaft 46 in a loose sleeve-like manner so as to extend longitudinally therealong. The interior of the tube 48 is thus defined by an inside diameter that is larger than the diameter of the pump shaft 46. The cleaning tube 48 has a longitudinal slot formed therethrough along its entire length. The slot 50 is of sufficient width to provide the drive shaft 46 to be inserted laterally into the tube 48. The cleaning tube 48 is preferably non-metallic, and more preferably is formed from a polyvinyl chloride (PVC) pipe. Therefore, the width of the slot 50 can be increased for insertion of the shaft 46 by forcibly spreading the slot along its length. Once installed on the shaft 46, the spreading force on the slot 50 is released so as to allow the slot 50 and the tube 48 to return to their original sizes. Then the tube 48 stays loosely in place on the shaft 46 until forcibly spread apart for removal. Thus, it will be understood that the width of the slot 50 is preferably less than the outer diameter of the shaft 46.

The john boat 10 includes a conventional means for steering 60, preferably a steering wheel 62 attached by one or more cables 64 to an arm 66 on the directional nozzle 39 so as to pivot it with respect to the discharge chute 38, transom 20 and the rest of the boat. Thus, the output from the discharge tube 38 can be directed in a variety of different directions to steer or propel the boat in various different directions. A shield 70 rigidly mounts to the transom 20 and extends rearwardly therefrom so as to protect the directional nozzle 39 from side blows. Alone or preferably as a part of the shield 70, a hydro-lift plate 72 extends beneath the rearwardly of the directional nozzle 39 so as to affect the hydroplaning characteristics of the boat 10.

It will be appreciated by one skilled in the art that the present invention makes it possible to provide a kit for converting a standard john boat to a jet driven john boat 10. The kit includes the carrier plate 42, sealing means such as gasket 59 and fastening means 57 for sealingly mounting the carrier plate in covering relation to the aperture 26. The kit also includes an in-line impeller type jet pump 32 and an engine 30 to drive the pump. Conventional fastening means 52 are provided in the kit for fastening the pump 32 and the engine 32 to the carrier plate 42.

Thus, the present invention also provides a method of making a jet driven john boat. The method includes the steps of: 1) providing an elongated john boat hull including a bottom wall and an upright transom at one end of the hull, the bottom wall having a keel portion and upper and lower surfaces; 2) forming an aperture through the keel portion adjacent the transom; 3) providing a carrier plate having an inlet opening extending therethrough, the carrier plate being of sufficient size to cover the aperture and the keel portion; 4) installing the carrier plate on the upper surface of the bottom wall in sealed covering relation to the aperture; 5) mounting an engine having an output shaft to the carrier plate inside the hull; 6) mounting to the carrier plate inside the hull a jet pump including an input shaft, an inlet connected to the aperture through the inlet opening, and a discharge chute mounted to and extending rearwardly beyond the transom; and 7) drivingly connecting the output shaft of the engine to the input shaft of the pump.

Thus, it can be seen that the present invention at least satisfies its stated objectives.

The preferred embodiments of the present invention have been set forth in the drawings and specification, and although specific terms are employed, these are used in a generic or descriptive sense only and are not used for purposes of limitations. Changes in the form and proportion of parts, as well as in the substitution of equivalents, are contemplated as circumstances may suggest or render expedient without departing from the spirit and scope of the invention as further defined in the following claims.

What is claimed is:

1. A jet-driven boat comprising:

an elongated john boat hull including a central longitudinal axis, a forward end defining a bow, a squared rearward end defining a stem with a transom extending upwardly thereon, and a substantially flat bottom wall;

the bottom wall including keel portion extending longitudinally therealong, the keel portion including an aperture formed therethrough for drawing in water at a keel level defined by the bottom wall of the hull;

a jet drive mounted on the keel portion inside the boat hull, the jet drive including an engine and a jet pump driven by the engine;

the jet pump including an inlet in fluid communication with the aperture in the keel portion and a pump discharge chute extending outside of the boat hull rearwardly of the transom, the pump discharge chute having a directional nozzle pivotally connected thereto, the directional nozzle being approximately tangent to the keel level;

wherein the pump is driven by an elongated pump drive shaft connected to the engine and an elongated cylindrical cleaning tube is loosely mounted on the pump drive shaft so as to extend longitudinally therealong, the cleaning tube having a longitudinal slot formed therethrough along its entire length, the slot being of a width that permits the drive shaft to be inserted laterally into the cleaning tube.

2. The boat of claim 1 wherein the cleaning tube is nonmetallic.

3. The boat of claim 2 wherein the cleaning tube is formed from a polyvinyl chloride pipe and the width of the slot is less than an outer diameter of the drive shaft.

4. A jet-driven boat comprising:

an elongated john boat hull including a central longitudinal axis, a forward end defining a bow, a squared rearward end defining a stern with a transom extending upwardly thereon, and a substantially flat bottom wall;

the bottom wall including keel portion extending longitudinally therealong, the keel portion including an aperture formed therethrough for drawing in water at a keel level defined by the bottom wall of the hull;

a jet drive mounted on the keel portion inside the boat hull, the jet drive including an engine and a jet pump driven by the engine;

the jet pump including an inlet in fluid communication with the aperture in the keel portion and a pump discharge chute extending outside of the boat hull rearwardly of the transom, the pump discharge chute having a directional nozzle pivotally connected thereto, the directional nozzle being approximately tangent to the keel level;

wherein both the engine and the jet pump are supported on a carrier plate that is mounted on the keel portion in covering relation to the aperture so as to extend substantially horizontally inside the boat hull, the carrier plate having a water suction opening therein that fluidly connects with the inlet of the jet pump and the aperture.

5. The boat of claim 4 the jet pump is an in-line jet pump that has a rotatable impeller and is free of a helical scroll for accelerating fluid passing therethrough.

6. The boat of claim 4 wherein the pump discharge chute is an elongated tube that extends through the transom and is sealingly and pivotally mounted with respect to the transom such that an upper surface of the tube is substantially parallel to and less than approximately six inches from the bottom of the hull adjacent to the transom.

7. The boat of claim 3 wherein the upper surface of the tube is less than approximately four inches from the bottom of the hull.

8. The boat of claim 4 wherein the carrier plate is rigid and has substantially parallel upper and lower planar surfaces, the engine and the jet pump being detachably mounted to the upper surface of the carrier plate.

9. The boat of claim 4 comprising a hydro-lift plate extending underneath and rearwardly beyond the directional nozzle to affect hydroplaning characteristics of the boat.

10. A kit for providing jet drive for a john boat having a bottom keel portion thereon comprising:

a carrier plate adapted to mount over an aperture formed through the bottom keel portion of the boat and to be disposed inside the boat, the carrier plate having a water intake hole formed therethrough;

means for sealingly mounting the carrier plate in covering relation to the aperture so that the intake hole is in fluid communication with the aperture;

an in-line impeller type jet pump fastenable to the carrier plate, the pump including a suction inlet connectable to the intake hole so as to be disposed inside the boat and a discharge chute extending outside the boat, the suction inlet of the pump being in fluid communication with the intake hole in the carrier plate;

means for fastening the pump to the carrier plate;

an engine drivingly connected to the jet pump and adapted to detachably mount to the carrier plate; and means for fastening the engine to the carrier plate.

11. A method of making a jet driven john boat comprising the steps of:

providing an elongated john boat hull including a bottom wall and an upright transom at one end of the hull, the bottom wall having keel portion and upper and lower surfaces;

forming an aperture through the keel portion adjacent the transom;

providing a carrier plate having an inlet opening extending therethrough, the carrier plate being of sufficient size to sealingly cover the aperture in the keel portion;

installing the carrier plate on the upper surface of the bottom wall in sealed covering relation to the aperture in the keel portion;

mounting an engine having an output shaft to the carrier plate inside the hull;

mounting to the carrier plate inside the hull a jet pump including an input shaft, an inlet connected to aperture through the inlet opening, and a discharge chute mounted to and extending rearwardly beyond the transom; and drivingly connecting the output shaft of the engine to the input shaft of the pump.

* * * * *